US008256207B2

(12) United States Patent
Takano et al.

(10) Patent No.: US 8,256,207 B2
(45) Date of Patent: Sep. 4, 2012

(54) EXHAUST EMISSION CONTROL DEVICE FOR INTERNAL COMBUSTION ENGINE

(75) Inventors: Atsushi Takano, Kariya (JP); Shinichiro Okugawa, Toyota (JP); Tsukasa Kuboshima, Okazaki-ken (JP)

(73) Assignee: Denso Corporation, Kariya (JP)

( * ) Notice: Subject to any disclaimer, the term of this patent is extended or adjusted under 35 U.S.C. 154(b) by 978 days.

(21) Appl. No.: 12/182,380

(22) Filed: Jul. 30, 2008

(65) Prior Publication Data

US 2009/0037082 A1 Feb. 5, 2009

(30) Foreign Application Priority Data

Aug. 3, 2007 (JP) ..... 2007-203435

(51) Int. Cl.
*F01N 3/18* (2006.01)

(52) U.S. Cl. ..... 60/286; 60/295

(58) Field of Classification Search ..... 60/285, 60/286, 295, 297
See application file for complete search history.

(56) References Cited

U.S. PATENT DOCUMENTS 7,152,392 B2 12/2006 Kuboshima et al.
7,254,941 B2 8/2007 Okugawa et al.
2004/0244366 A1* 12/2004 Hiranuma et al. ..... 60/286
2005/0247052 A1* 11/2005 Kobayashi et al. ..... 60/297
2009/0235644 A1* 9/2009 Wu et al. ..... 60/285

FOREIGN PATENT DOCUMENTS

JP 2004-124855 4/2004
JP 2005-351264 12/2005
JP 2007-023961 2/2007
JP 2008-002349 1/2008
WO WO 2007010701 A1 * 1/2007

* cited by examiner

*Primary Examiner* — Thomas Denion
*Assistant Examiner* — Jonathan Matthias
(74) *Attorney, Agent, or Firm* — Nixon & Vanderhye P.C.

(57) ABSTRACT

An exhaust emission control device removes particulate matters contained in exhaust gas of an internal combustion engine and deposited in a particulate filter. The device has a catalyst judging block judging the catalytic activity of catalyst held in the particulate filter, an exhaust gas detecting block detecting a flow rate of the exhaust gas, an injection type selecting block selecting a first fuel injection type or a second fuel injection type according to the catalytic activity and the flow rate of the exhaust gas, and a fuel injection control block controlling fuel injected into the engine to heighten the temperature of the exhaust gas according to the first fuel injection type and to supply unburned hydrocarbons to the particulate filter according to the second fuel injection type.

20 Claims, 8 Drawing Sheets

EXHAUST EMISSION CONTROL DEVICE FOR INTERNAL COMBUSTION ENGINE

CROSS-REFERENCE TO RELATED APPLICATION

This application is based upon and claims the benefit of priority of the prior Japanese Patent Application 2007-203435 filed on Aug. 3, 2007, so that the contents of which are incorporated herein by reference.

BACKGROUND OF THE INVENTION

1. Field of the Invention

The present invention relates to an exhaust emission control device which controls regeneration of a diesel particulate filter to remove particulate matters contained in exhaust gas of an internal combustion engine and deposited in the filter.

2. Description of Related Art

For the environmental protection, it is necessary to purify exhaust gas outputted from an internal combustion engine of a vehicle. For example, it is necessary to remove particulate matters from exhaust gas of a diesel engine. To remove particulate matters, a diesel particulate filter (hereinafter, called DPF) is disposed in an exhaust pipe through which the exhaust gas outputted from the engine flows. The DPF normally has a filter formed in a honeycomb structure. This honeycomb filter catches and collects a major portion of particulate matters outputted from the engine, so that the exhaust gas is purified.

However, each time a certain quantity of particulate matters are deposited in the DPF, it is necessary to burn the deposited particulate matters for the purpose of regenerating the DPF. As a technique for burning the particulate matters, post injection of fuel is well known. In this post injection, fuel is injected into the engine at a timing retarded from a timing of the normal main injection of fuel.

As the post injection, both multi-post injection and single-post injection are known. In the multi-post injection, a series of fuel injections is performed after the main fuel injection. In the single-post injection, only one fuel injection is performed after the main fuel injection. In case of the multi-post injection, the combustion of fuel is continued in cylinders of the engine to rise the temperature of exhaust gas outputted from the engine. The temperature of the DPF receiving this exhaust gas is risen, so that particulate matters of the DPF are burned. That is, the DPF is purified in response to the temperature rise based on the exhaust gas (hereinafter, called exhaust gas-based temperature rise).

In contrast, in case of the single-post injection, a major portion of fuel injected in the post injection is not burned in the engine, so that unburned hydrocarbons are outputted from the engine and are fed to the DPF. In the DPF, the hydrocarbons are oxidized due to the catalytic reaction caused by catalyst of the DPF, so that the temperature of the DPF is risen by heat generated in the reaction of the hydrocarbons. Therefore, particulate matters of the DPF are burned. That is, the DPF is purified in response to the temperature rise based on hydrocarbons (hereinafter, called hydrocarbon-based temperature rise).

FIG. 1A shows the relationship between the injection valve lift position and the heat release rate in a diesel engine in case of the exhaust gas-based temperature rise, while FIG. 11 shows the relationship between the injection valve lift position and the heat release rate in a diesel engine in case of the hydrocarbon-based temperature rise.

As shown in FIG. 1A and FIG. 1B, main injection is performed at a timing of compression top dead center (TDC). After the main injection, multi-post injection or single-post injection is performed in a period of time between TDC and after top dead center 90 (ATDC90) Heat is generated in an engine in response to the multi-post injection, so that the temperature of exhaust gas is heightened. In contrast, no heat is substantially generated in response to the single-post injection, so that unburned hydrocarbons are outputted from the engine.

When particulate matters are deposited in the DPF, the particulate matters are often deposited in layers on the catalyst held on the front end surface of the DPF. In this case, it is difficult to burn the particulate matters deposited on the front end surface of the DPF by oxidizing unburned hydrocarbons. Therefore, to burn the particulate matters deposited on the front end surface of the DPF, it is required to heighten the temperature of the exhaust gas passing though the DPF.

In the exhaust system holding the catalyst on the upstream side of the DPF, the temperature of the exhaust gas is sometimes risen in response to the oxidation of hydrocarbons based on the catalytic reaction. Therefore, to burn the particulate matters deposited on the front end surface of the DPF, it is not necessary to heighten the temperature of the exhaust gas outputted from the engine. In contrast, in the single DPF system holding no catalyst on the upstream side of the DPF, to burn the particulate matters deposited on the front end surface of the DPF, it is indispensable to heighten the temperature of the exhaust gas outputted from the engine.

In the hydrocarbon-based temperature rise, unburned hydrocarbons not burned in cylinders of the engine are fed to the DPF and are oxidized based on the catalytic reaction, so that the temperature of the DPF is risen. Therefore, the temperature of the exhaust gas outputted from the engine is generally low. In contrast, in the exhaust gas-based temperature rise, fuel injected in the multi-post injection is continuously burned in the engine, so that the temperature of the exhaust gas is heightened. Therefore, the temperature of the exhaust gas outputted from the engine is high. Therefore, for the regeneration of the DPF in the single DPF system, the exhaust gas-based temperature rise is often used.

However, in the exhaust gas-based temperature rise, the heat of the exhaust gas outputted from the engine and flowing through the exhaust pipe is easily dissipated to the outside through the exhaust pipe before the exhaust gas is fed to the DPF. Therefore, to give the dissipated heat and the regeneration heat to the exhaust gas outputted from the engine, it is required to inject a large quantity of fuel in the post injection. In this case, because the temperature of the exhaust gas outputted from the engine is sufficiently heightened to reliably rise the temperature of the DPF, fuel is excessively consumed. Therefore, fuel economy in the vehicle deteriorates.

In contrast, in the combustion of the particulate matters deposited on the front end surface of the DPF, the hydrocarbon-based temperature rise is inferior to the exhaust gas-based temperature rise. However, to rise the temperature of the whole DPF, the hydrocarbon-based temperature rise is superior to the exhaust gas-based temperature rise. That is, in case of the hydrocarbon-based temperature rise, the temperature of the DPF is rapidly risen so as to rapidly regenerate the DPF, so that the deterioration of fuel economy can be suppressed. In the prior art, because only the exhaust gas-based temperature rise is used to regenerate the DPF, the merits of the hydrocarbon-based temperature rise are not obtained.

Assuming that an exhaust emission control device appropriately controls the regeneration of the DPF while considering the merits and demerits in both the exhaust gas-based temperature rise and the hydrocarbon-based temperature rise, the temperature of the DPF is rapidly risen, and fuel consumption in the DPF regeneration is suppressed.

For example, Published Japanese Patent First Publication No. 2007-23961 discloses a fuel injection control device. In this device, to improve the durability of the engine and to lengthen the maintenance interval, the dilution of oil caused by the usage of both the exhaust gas-based temperature rise and the hydrocarbon-based temperature rise is suppressed. More specifically, in response to engine conditions, the post injection for the exhaust gas-based temperature rise is performed for some of cylinders of the engine, and the post injection for the hydrocarbon-based temperature rise is performed for the other cylinders of the engine. That is, the injection mode is set for each cylinder to operate the cylinders according to different injection modes.

However, the prior art including the Publication No. 2007-23961 does not teach or even suggest a technique for alternately selecting the exhaust gas-based temperature rise and the hydrocarbon-based temperature rise to rapidly regenerate the DPF in the single DPF system holding no catalyst on the upstream side of the DPF.

SUMMARY OF THE INVENTION

An object of the present invention is to provide, with due consideration to the drawbacks of the conventional exhaust emission control device, an exhaust emission control device which controls regeneration of a particulate filter in a single DPF system so as to rapidly remove particulate matters deposited in the particulate filter.

According to a first aspect of this invention, the object is achieved by the provision of an exhaust emission control device which controls fuel injected into an internal combustion engine to remove particulate matters deposited in a particulate filter, comprising a catalyst judging block that judges whether or not a catalyst held in the particulate filter is in an active state or in an inactive state, an exhaust gas detecting block that detects a flow rate of exhaust gas which is outputted from the engine and passes through the particulate filter, an injection type selecting block that selects either a first fuel injection type or a second fuel injection type according to the judgment of the catalytic state judging block and the flow rate of the exhaust gas detected in the exhaust gas detecting block, and a fuel injection control block that controls the fuel injected into the internal combustion engine to heighten a temperature of the exhaust gas when the injection type selecting block selects the first fuel injection type and to supply an unburned hydrocarbon to the particulate filter when the injection type selecting block selects the second fuel injection type.

With this structure of the exhaust emission control device, only when the catalyst is in an active state, the unburned hydrocarbon can be oxidized due to the catalytic reaction. When the regeneration of the particulate filter is not yet started, the catalyst is, for example, in an inactive state because of the low temperature of the particulate filter. When the regeneration of the filter is started, the selecting block initially selects the first fuel injection type, and the control block controls the fuel to heighten the temperature of the exhaust gas. Therefore, the temperature of the filter heated by the exhaust gas is gradually risen, and the catalyst becomes active.

Further, when the flow rate of the exhaust gas is large, heat lost from the exhaust gas per unit quantity becomes small. Therefore, it is advantageous to remove the particulate matters from the particulate filter according to the first fuel injection type in which the temperature of the exhaust gas is heightened. In contrast, when the flow rate of the exhaust gas is small, it is advantageous to remove the particulate matters from the particulate filter according to the second fuel injection type in which the unburned hydrocarbon is supplied to the particulate filter. Further, to quickly remove the particulate matters from the particulate filter, the second fuel injection type is superior to the first fuel injection type.

In a case where the flow rate of the exhaust gas is small, the selecting block changes the selection of the fuel injection type to the second fuel injection type when the catalyst is set to the active state due to the temperature rise of the filter. In contrast, in a case where the flow rate of the exhaust gas is large, the selecting block always selects the first fuel injection type.

Accordingly, because the selecting block selects the first or second fuel injection type according to the catalytic state and the flow rate of the exhaust gas while changing the selection of the fuel injection type during the regeneration, the particulate matters can be quickly removed from the particulate filter. Further, the particulate matters deposited on the front end surface of the filter can be reliably removed according to the first fuel injection type. Moreover, the fuel economy can be improved due to the second fuel injection type.

According to a second aspect of this invention, the object is achieved by the provision of an exhaust emission control device which controls fuel injected into an internal combustion engine to remove particulate matters deposited in a particulate filter, comprising a catalyst judging block that judges whether or not catalyst held in the particulate filter is in an active state or in an inactive state, an estimating block that estimates an amount of the particulate matters, an injection type selecting block that selects either a first fuel injection type or a second fuel injection type according to the judgment of the catalytic state judging block and the amount of the particulate matters estimated in the estimating block, and a fuel injection control block that controls the fuel injected into the internal combustion engine to heighten the temperature of the exhaust gas when the injection type selecting block selects the first fuel injection type and to supply an unburned hydrocarbon to the particulate filter when the injection type selecting block selects the second fuel injection type.

With this structure of the exhaust emission control device, when the catalyst is in the inactive state, it is impossible to regenerate the filter according to the second fuel injection type. Therefore, the selecting block selects the first fuel injection type, and the control block controls the fuel to heighten the temperature of the exhaust gas. In contrast, when the catalyst is in an active state, the filter can be regenerated according to any of the first and second fuel injection types.

To quickly heighten the temperature of the whole filter, the second fuel injection type is superior to the first fuel injection type. Therefore, when the amount of the particulate matters is large, it is advantageous to remove the particulate matters from the filter according to the second fuel injection type. In contrast, when the amount of the particulate matters is small, the combustion speed in the second fuel injection type is similar to that in the first fuel injection type. Further, when the particulate matters of the filter are removed according to the second fuel injection type, the particulate matters deposited on the front end surface of the filter are insufficiently removed.

Therefore, when the regeneration of the particulate filter is just started on condition that the catalyst is in the active state, the selection block selects the second fuel injection type, and the control block controls the fuel to quickly remove a large amount of particulate matters. When the amount of the particulate matters becomes small during this regeneration, the selection block changes the selection to the first fuel injection type, and the control block controls the fuel to mainly remove the particulate matters deposited on the front end surface of the filter.

Accordingly, because the selecting block selects the first or second fuel injection type according to the catalytic state and the amount of the particulate matters while changing the selection of the fuel injection type during the regeneration, the particulate matters can be quickly removed from the particulate filter. Further, the particulate matters deposited on the front end surface of the filter can be reliably removed according to the first fuel injection type. Moreover, the fuel economy can be improved due to the second fuel injection type.

DETAILED DESCRIPTION OF THE PREFERRED EMBODIMENTS

Embodiments of the present invention will now be described with reference to the accompanying drawings.

Embodiment 1

Figure 2:
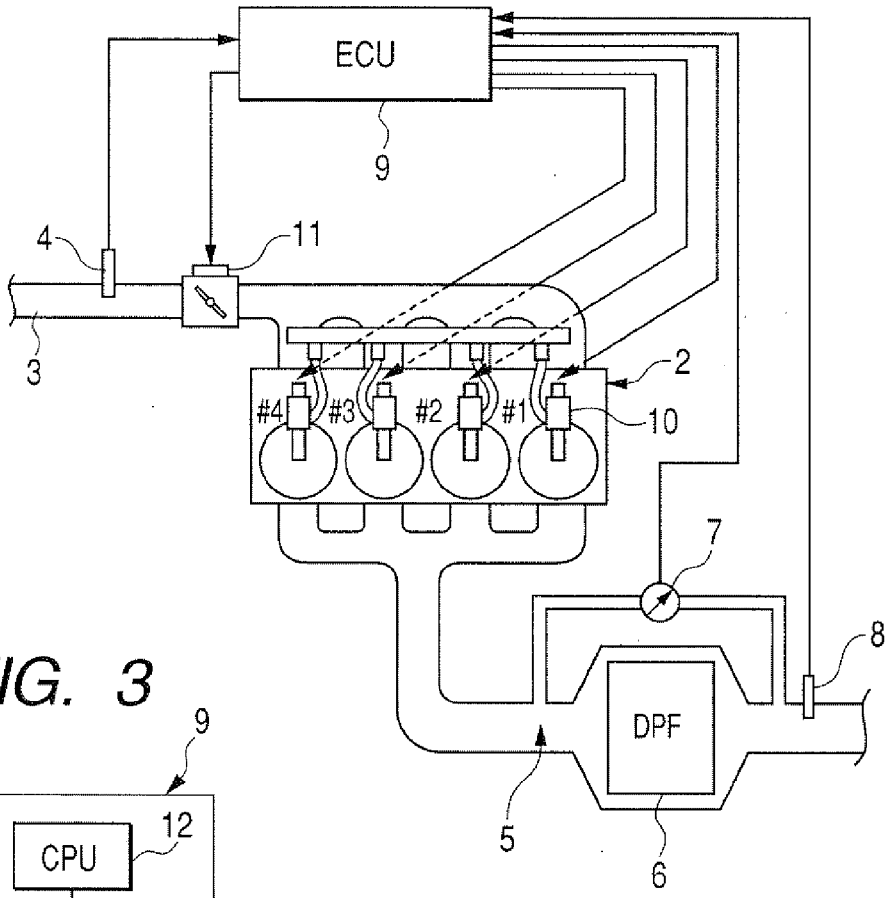
FIG. 2 is a schematic view of an exhaust emission control device according to embodiments of the present invention.

FIG. 2 is a schematic view of an exhaust emission control device according to the first embodiment.

As shown in FIG. 2, an exhaust emission control device 1 is disposed to purify exhaust gas outputted from a diesel engine 2 with four cylinders. An intake pipe 3 is connected with the engine 2 so as to communicate with the cylinders of the engine 2. Air is supplied to the cylinders of the engine 2 through the pipe 3. An exhaust pipe 5 is connected with the engine 2 so as to communicate with the cylinders of the engine 2. Exhaust gas of the engine 2 passes through the pipe 5.

A diesel particulate filter (hereinafter, called DPF) 6 is disposed in the middle of the pipe 5. No oxidation catalyst is disposed on the upstream side of the DPF 6. Therefore, the control device 1 controls regeneration of the DPF 6 in a single DPF system. The DPF 6 holds oxidation catalyst so as to act as a DPF (C-DPF) with oxidation catalyst.

An air flow meter 4 is disposed in the pipe 3 on the inlet side of the engine 2 to measure a volume flow rate of air inputted to the engine 2. An exhaust gas temperature sensor 8 is disposed on the outlet side of the DPF 6 to measure the temperature of the exhaust gas outputted from the DPF 6. A differential pressure sensor 7 is disposed to measure the difference (i.e. differential pressure) in pressure of the exhaust gas between the inlet side of the DPF 6 and the outlet side of the DPF 6.

An electronic control unit (ECU) 9 is disposed to adjust the flow rate of air taken into the engine 2, the quantity of fuel injected into the engine 2 in the main injection and the post injection, and the like in response to the meter 4 and the sensors 7 and 8 and the like. A fuel injection valve 10 is attached to each cylinder of the engine 2 and injects a quantity of fuel determined by the ECU 9 into the cylinder of the engine 2 under control of the ECU 9. A throttle valve 11 is disposed in the pipe 3 and adjusts the flow rate of air taken into the engine 2 under control of the ECU 9. Therefore, the ECU 9 controls the driving operation of the engine 2.

The control device 1 is composed of the ECU 9 and the sensors 4, 7 and 8.

The DPF 6 is formed in a honeycomb structure, and the inlet and outlet sides of the DPF 6 are alternately packed with the filter walls. The exhaust gas outputted from the engine 2 during the driving operation contains particulate matters. When the exhaust gas passes through the filter walls of the DPF 6, these particulate matters are caught by the filter walls and are deposited on the surfaces of the filter walls including the front end surface and in the inside of the filter walls. Each time a predetermined quantity or amount of particulate matters are deposited in the DPF 6, the deposited particulate matters are burned and removed to regenerate the DPF 6.

Figure 1A:
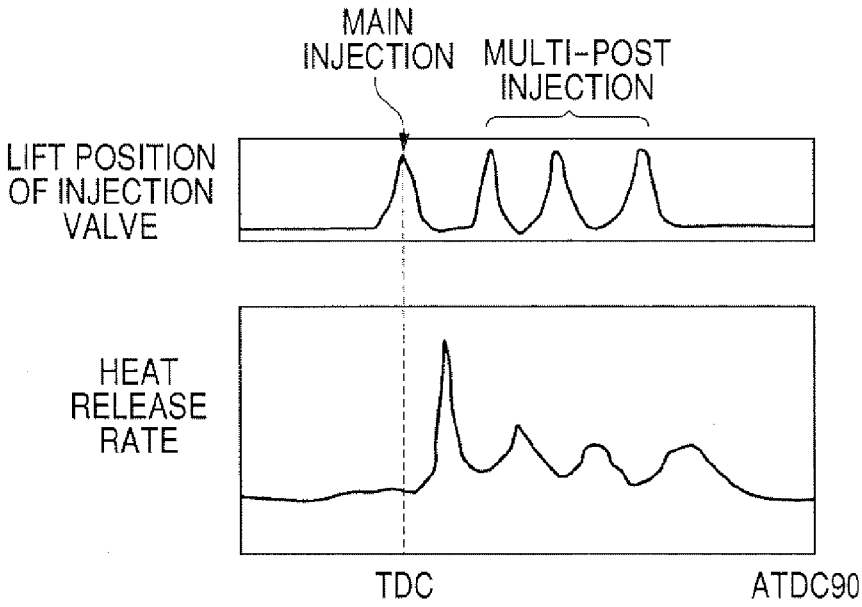
FIG. 1A (PRIOR ART)
FIG. 1A shows the relationship between injection valve lift position and heat release rate in a diesel engine in case of the exhaust gas-based temperature rise.
Figure 1B:
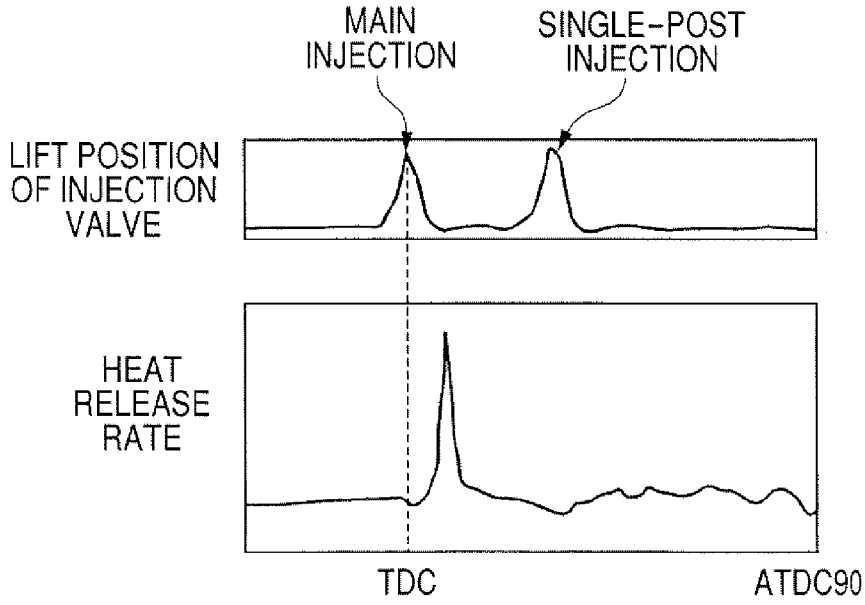
FIG. 1B (PRIOR ART)
FIG. 1B shows the relationship between injection valve lift position and heat release rate in the diesel engine in case of the hydrocarbon-based temperature rise.

To regenerate the DPF 6, a method of the exhaust gas-based temperature rise and a method of the hydrocarbon-based temperature rise are used. For example, one of the methods is used every DPF regeneration, or the methods are alternately used every DPF regeneration. The exhaust gas-based temperature rise denotes the multi-post injection shown in FIG. 1A, and the hydrocarbon-based temperature rise denotes the single-post injection shown in FIG. 1B.

In case of the selection of the exhaust gas-based temperature rise, after fuel is injected into the engine 2 in the main injection, fuel is injected in the multi-post injection and is burned in the cylinders of the engine 2. Therefore, the temperature of the exhaust gas is increased, the exhaust gas set at the high temperature flows through the DPF 6, and the particulate matters deposited in the DPF 6 are burned and removed.

In contrast, In case of the selection of the hydrocarbon-based temperature rise, unburned hydrocarbons are fed from the engine 2 to the DPF 6 and are oxidized by the catalytic reaction caused by the catalyst of the DPF 6, the temperature of the DPF 6 is risen, and the particulate matters deposited in the DPF 6 are burned and removed.

Figure 3:
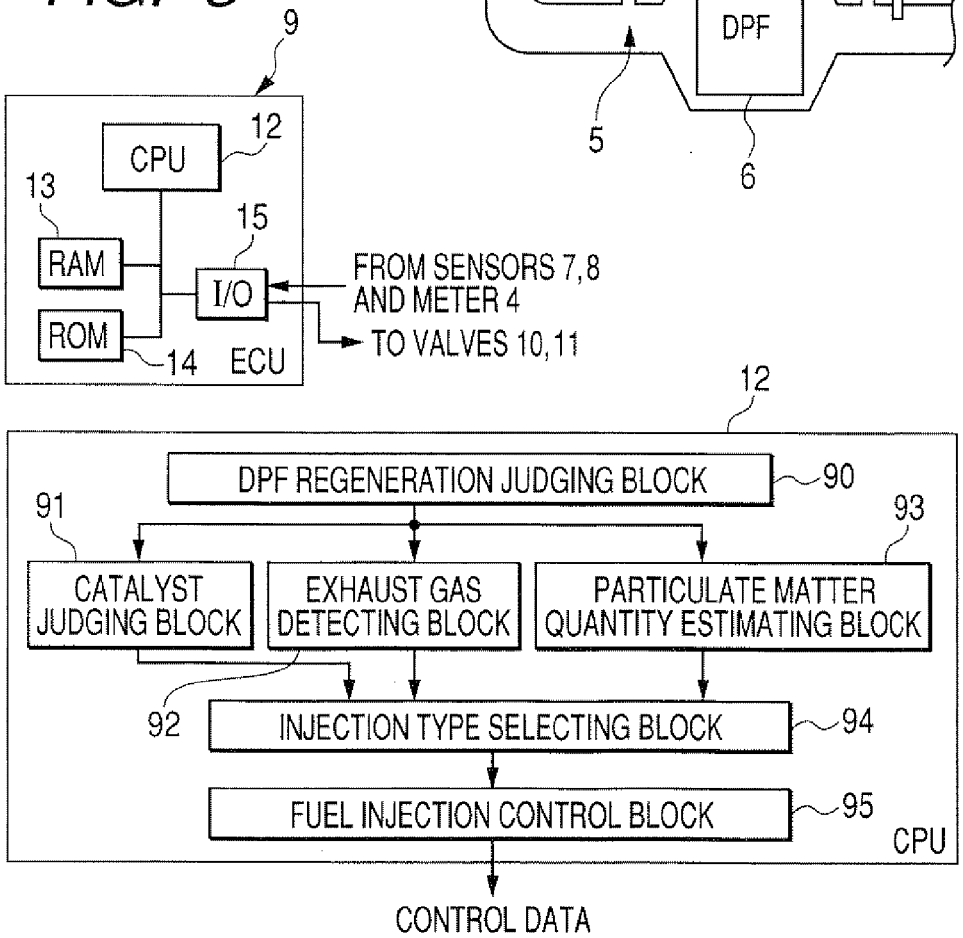
FIG. 3 is a block diagram of an ECU shown in FIG. 2 according to the embodiments.

FIG. 3 is a block diagram of the ECU 9. As shown in FIG. 3, the ECU 9 has a central processing unit (CPU) 12, a random access memory (RAM) 13, a read only memory (ROM) 14, and an input-output (I/O) interface 15 through which values detected in the meter 4 and the sensors 7 and 8 are stored in the RAM 13 and control data are outputted to the valves 10 and 11. The ROM 14 stores computer programs for the DPF regeneration. The RAM 13 temporarily stores the detected values and the control data. The CPU 12 calculates the control data from the detected values stored in the RAM 14 according to the programs of the ROM 15. The valve 10 injects fuel into the engine 2 according to the control data, and the valve 11 adjusts the flow rate of air taken in the engine 2 according to the control data.

The CPU 12 of the ECU 9 has a DPF regeneration judging block 90, a catalyst judging block 91, an exhaust gas detecting block 92, a particulate matter quantity estimating block 93, an injection type selecting block 94, and a fuel injection control block 95.

The judging block 90 judges based on the detected value of the sensor 7 whether or not the DPF 6 should be regenerated. When the DPF 6 should be regenerated, the blocks 91 to 95 are operated. The judging block 91 judges based on the detected value of the temperature sensor 8 whether or not the catalyst held in the DPF 6 is in an active state or in an inactive state. The detecting block 92 detects the flow rate of the exhaust gas passing through the DPF 6 from the flow rate of the air measured in the meter 4. The estimating block 93 estimates the quantity of particulate matters deposited in the DPF 6 from the differential pressure detected in the sensor 7.

The selecting block 94 selects either the exhaust gas-based temperature rise (i.e., first fuel injection type) or the hydrocarbon-based temperature rise (i.e., second fuel injection type) according to the judgment of the judging block 91 and the flow rate of the exhaust gas detected in the detecting block 92 (first embodiment), according to the judgment of the judging block 91 and the quantity of the particulate matters estimated in the estimating block 93 (second embodiment) or according to the judgment of the judging block 91, the flow rate of the exhaust gas, and the quantity of the particulate matters (third embodiment). The control block 95 controls the quantity of the fuel injected into the engine 2 to heighten the temperature of the exhaust gas when the selecting block 94 selects the exhaust gas-based temperature rise and to supply unburned hydrocarbons to the DPF 6 when the selecting block 94 selects the hydrocarbon-based temperature rise.

Figure 4:
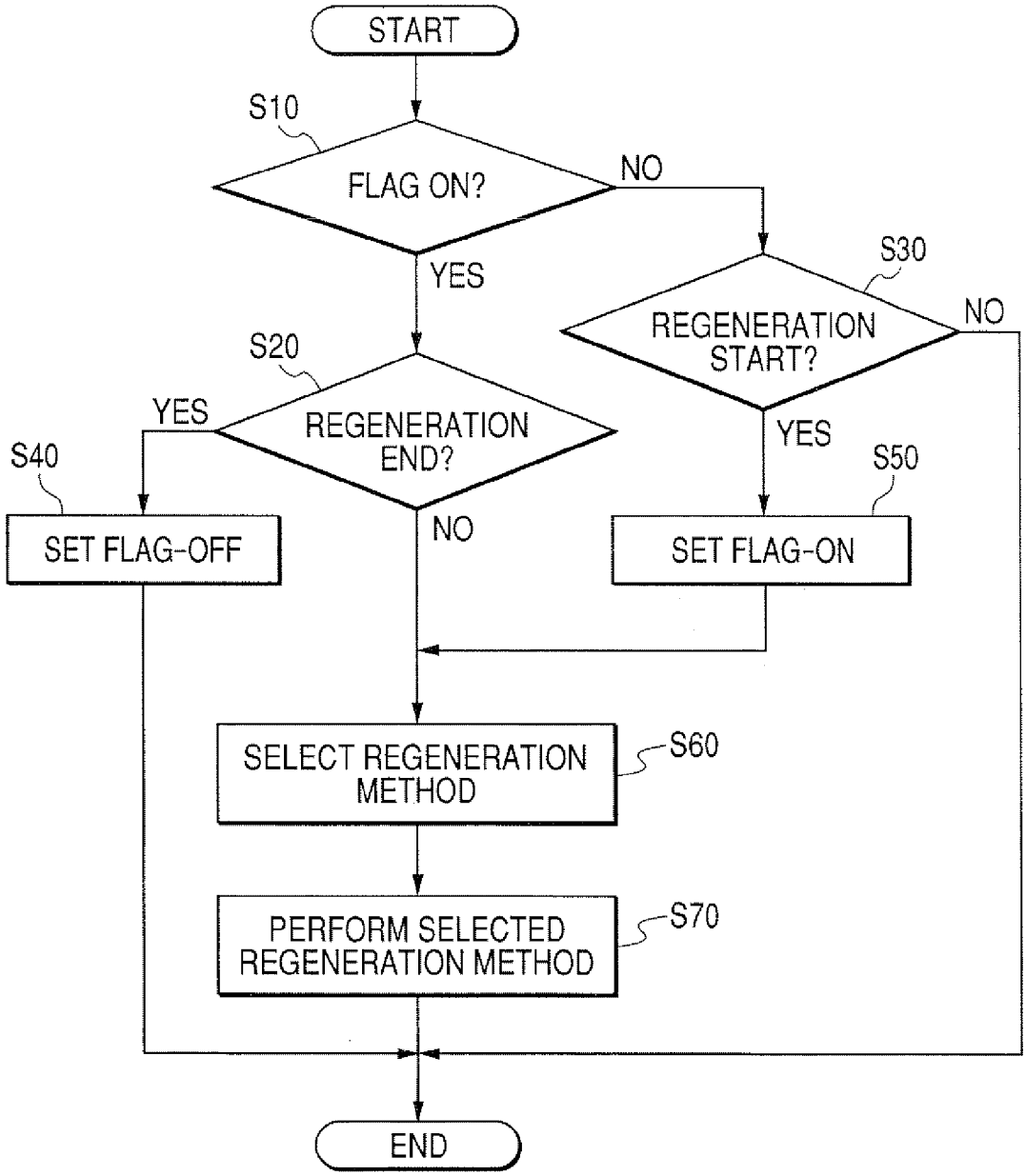
FIG. 4 is a flow chart of the whole DPF regeneration process performed in the control device shown in FIG. 2 according to the embodiments.

The DPF regeneration process is now described with reference to FIG. 4 and FIG. 5. FIG. 4 is a flow chart of the DPF regeneration process performed in the control device 1. This DPF regeneration process is periodically performed under control of the ECU 9.

As shown in FIG. 4, at step S10, the ECU 9 judges whether or not a DPF regeneration flag is set in the on-state. The flag set in the on-state denotes that the DPF 6 needs the DPF regeneration. When the driving operation of the engine 2 is started, the flag is initially set to the off-state. When the flag is set in the off-state, the procedure proceeds to step S30.

At step S30, the ECU 9 judges whether or not the regeneration of the DPF 6 should be started. This judgment is performed based on the detected values of the meter 4 and the sensors 7 and 8. For example, the differential pressure of the DPF 6 is measured, the quantity of particulate matters deposited in the DPF 6 is estimated from the differential pressure. When the estimated quantity of the particulate matters exceeds a predetermined threshold value, the ECU 9 judges that the particulate matters deposited in the DPF 6 exceeds a regeneration value, and the ECU 9 judges that the DPF regeneration should be started. When the ECU 9 judges that the DPF regeneration should be started, the procedure proceeds to step S50. In contrast, when the ECU 9 judges that the DPF 6 does not need the DPF regeneration, this process is finished.

At step S50, the ECU 9 sets the DPF regeneration flag to the on-state, and the procedure proceeds to step S60.

When the ECU 9 judges at step S10 that the flag is set in the on-state, the regeneration of the DPF 6 has been already started. Therefore, the procedure proceeds to step S20.

At step S20, the ECU 9 judges whether or not the regeneration of the DPF 6 should be ended. This judgment is performed based on the detected values of the meter 4 and the sensors 7 and 8. For example, the quantity of particulate matters deposited in the DPF 6 is estimated based on the differential pressure measured in the sensor 7. When the estimated quantity of the particulate matters is lower than a predetermined value, the ECU 9 judges that the particulate matters deposited in the DPF 6 are sufficiently burned, and the ECU 9 judges that the DPF 6 doe not need the DPF regeneration anymore. That is, the ECU 9 judges that the regeneration of the DPF 6 should be ended.

When the ECU 9 judges at step S20 that the regeneration of the DPF 6 should be ended, the procedure proceeds to step S40. At step S40, the ECU 9 sets the DPF regeneration flag to the off-state. Then, this process is completed.

In contrast, when the ECU 9 judges at step S20 that the regeneration of the DPF 6 should be continued, the procedure proceeds to step S60.

At step S60, the ECU 9 selects a DPF regeneration method from the method of the exhaust gas-based temperature rise and the method of the hydrocarbon-based temperature rise. When the DPF regeneration method is selected after the step S20, the selection is performed during the DPF regeneration. This selection is described in detail later. Then, at step S70, the selected DPF regeneration method is performed under control of the block 95 of the ECU 9. For example, the DPF regeneration is continued for a predetermined period of time. This period of time may equal the cycle of this DPF regeneration process. Then, this process is completed. In this case, the flag is still set in the on-state.

The DPF regeneration judging process at steps S10 to S50 is performed in the judging block 90 of the ECU 9. The selection of the DPF regeneration method is performed in the blocks 91 to 94 of the ECU 9.

The selection of the DPF regeneration method at step S60 will be described hereinafter.

When the temperature of the DPF 6 is equal to or higher than a lower limit value T1 such as 200° C., the catalyst held in the DPF 6 is activated. That is, the catalyst is in the active state. In this case, when unburned hydrocarbons are fed to the DPF 6, the unburned hydrocarbons receive catalytic action from the activated catalyst. Therefore, the unburned hydrocarbons can be oxidized in the DPF 6 due to the catalytic reaction so as to rise the temperature of the DPF 6. In contrast, when the temperature of the DPF 6 is lower than the lower limit value T1, the catalyst held in the DPF 6 is deactivated. That is, the catalyst is in the inactive state. In this case, even when unburned hydrocarbons are fed to the DPF 6, the unburned hydrocarbons receive no catalytic action from the deactivated catalyst. Therefore, no catalytic reaction is caused in the unburned hydrocarbons, so that the unburned hydrocarbons are not oxidized in the DPF 6. That is, the hydrocarbon-based temperature rise needs the DPF 6 set to a temperature equal to or higher than the lower limit value T1. In contrast, in case of the selection of the exhaust gas-based temperature rise, the temperature of the DPF 6 can be risen by the exhaust gas regardless of the temperature of the DPF 6.

The heat dissipation or loss of the exhaust gas is now described. The temperature of the exhaust gas in the exhaust gas-based temperature rise is higher than that in the hydrocarbon-based temperature rise. Therefore, in the exhaust gas-based temperature rise, the heat of the exhaust gas flowing through the exhaust pipe 5 is easily dissipated to the outside of the exhaust system, so that the fuel economy deteriorates. However, when the flow rate of the exhaust gas is equal to or larger than a predetermined value, in other words, when the flow rate of the taken air changing with the flow rate of the exhaust gas is equal to or larger than a predetermined value G1, the thermal capacity of the exhaust gas flowing through the exhaust pipe 5 becomes sufficiently high. In this case, the dissipated heat per unit flow rate of the exhaust gas can be sufficiently reduced, so that the fuel economy can be improved. Therefore, when the flow rate of the air fed into the engine 2 is equal to or larger than the predetermined value G1, the exhaust gas-based temperature rise is selected. In contrast, when the flow rate of air fed into the engine 2 is smaller than the predetermined value G1, the hydrocarbon-based temperature rise is selected.

In conclusion, in this embodiment, when the temperature of the DPF 6 is equal to or higher than the lower limit value T1 while the flow rate of air taken into the engine 2 is lower than the predetermined value G1, the hydrocarbon-based temperature rise is selected. In contrast, in other cases, the exhaust gas-based temperature rise is selected.

An example of the selection of the DPF regeneration method at step S60 will be described in detail with reference to FIG. 5. FIG. 5 is a flow chart showing the selection of the DPF regeneration method according to the first embodiment. In this selection, the estimating block 93 is not operated, so that the sensor 7 is not used.

Figure 5:
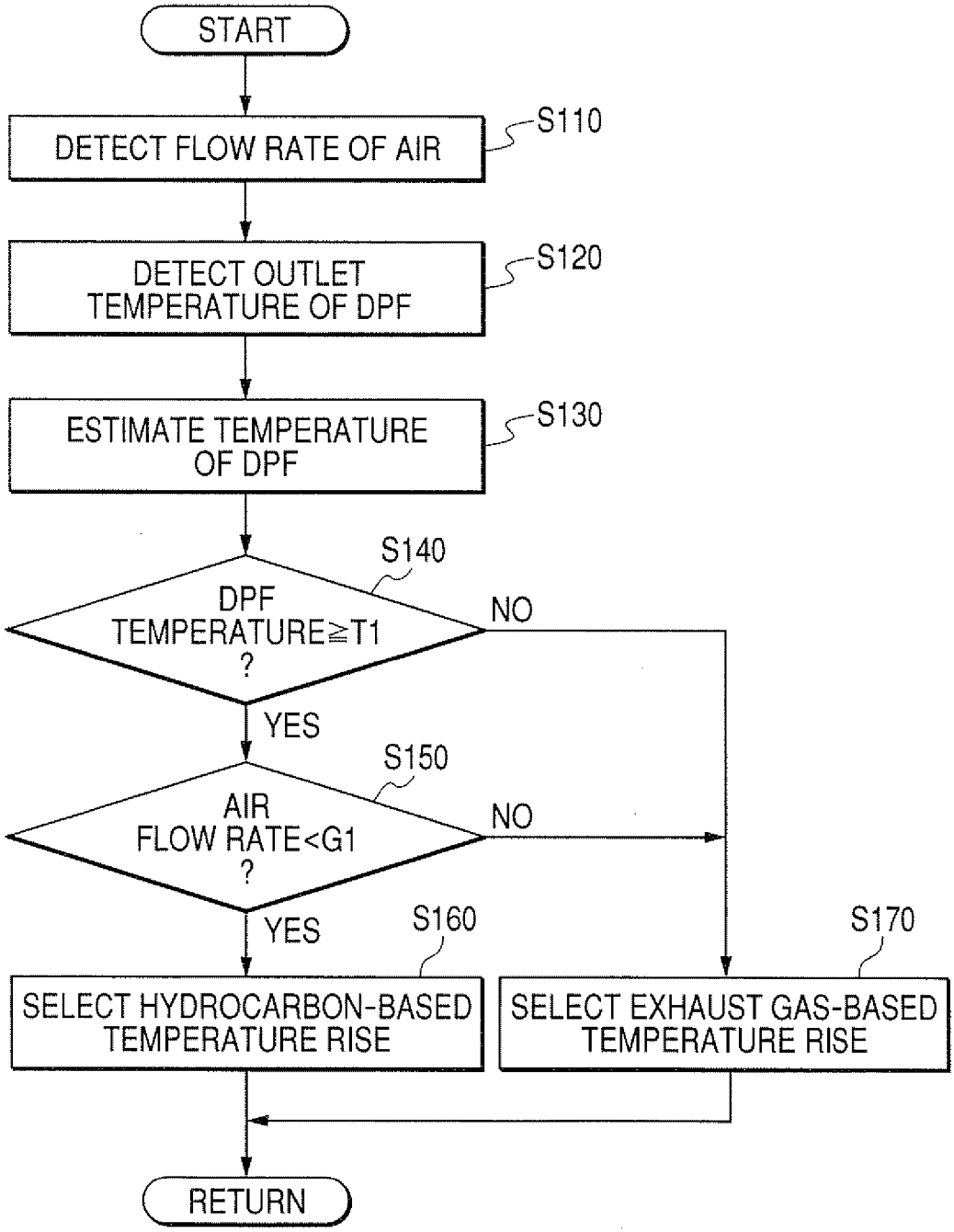
FIG. 5 is a flow chart showing the selection of the DPF regeneration method according to the first embodiment of the present invention.

As shown in FIG. 5, at step S110, the ECU 9 detects the flow rate of new air taken in the engine 2. This flow rate of the new air is measured by the flow meter 4. At step S120, the ECU 9 detects the outlet temperature of the DPF 6 at the outlet side of the DPF 6. This temperature is measured by the sensor 8.

At step S130, the ECU 9 estimates the internal temperature of the DPF 6 from the outlet temperature of the exhaust gas measured by the sensor 8. For example, the ECU 9 may estimate the internal temperature of the DPF 6 from the relationship between the internal temperature of the DPF 6 and the outlet temperature of the DPF 6. More specifically, before this estimation, the outlet side of the DPF 6 is actually set at various outlet temperatures, the internal temperature of the DPF 6 corresponding to each outlet temperature is measured, and a map indicating the relationship between the internal temperature and the outlet temperature in a predetermined temperature range is prepared and stored in a memory in advance. The ECU 9 estimates the internal temperature of the DPF 6 with reference to this map. Therefore, the ECU 9 can easily estimate the internal temperature of the DPF 6 from the outlet temperature stored in the memory. The internal temperature of the DPF 6 may be an average temperature of the whole DPF 6.

At step S140, the judging block 91 of the ECU 9 judges whether or not the estimated internal temperature is equal to or higher than the value T1. When the estimated internal temperature is equal to or larger than the value T1, the procedure proceeds to step S150. In contrast, when the estimated internal temperature is lower than the value T1, the procedure proceeds to step S170.

At step S150, the detecting block 92 of the ECU 9 judges whether or not the flow rate of the new air detected at step S110 is smaller than the value G1. When the flow rate of the new air is smaller than the value G1, the procedure proceeds to step S160. In contrast, when the flow rate of the new air is equal to or larger than the value G1, the procedure proceeds to step S170.

At step S160, the ECU 9 selects the hydrocarbon-based temperature rise as the DPF regeneration method. Then, this process is completed.

At step S170, the ECU 9 selects the exhaust gas-based temperature rise as the DPF regeneration method. Then, this process is completed.

Figure 6:
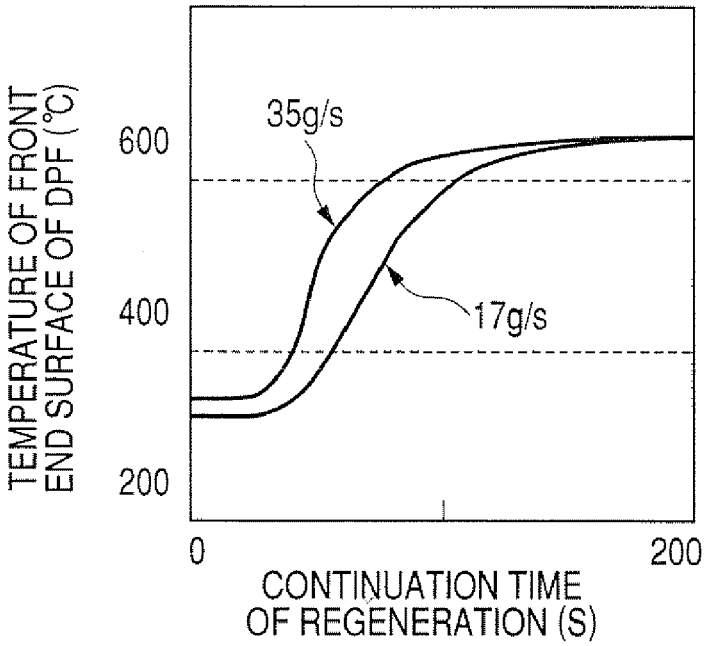
FIG. 6 shows the relationship between the continuation time of DPF regeneration and the temperature at the front end surface of a DPF in case of the exhaust gas-based temperature rise.
Figure 7:
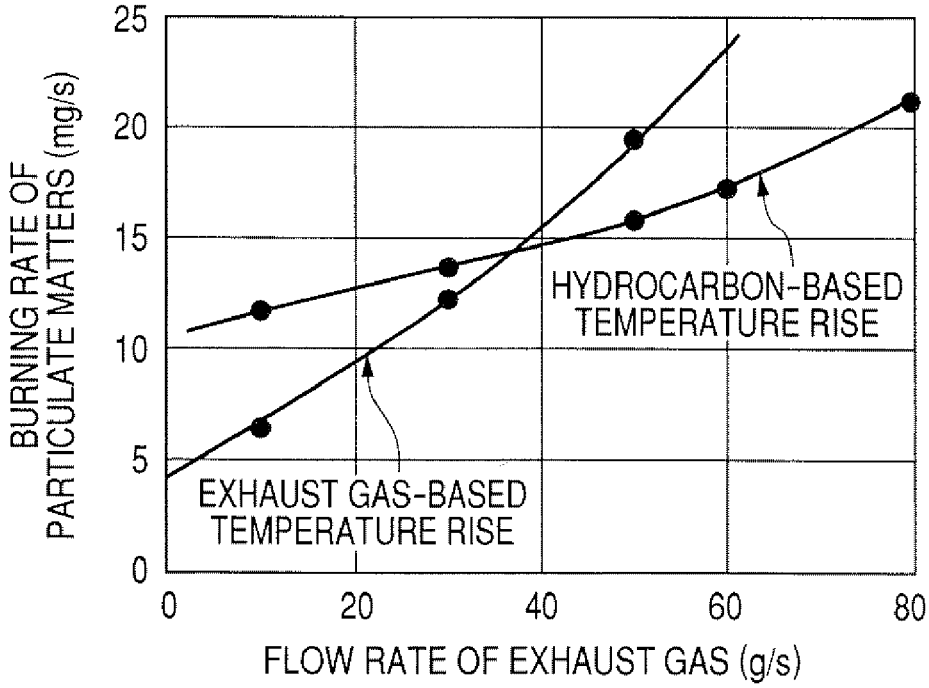
FIG. 7 shows the relationship between the flow rate of exhaust gas and the burning rate of particulate matters deposited in the DPF.

Effects in the first embodiment are described with reference to FIG. 6 and FIG. 7. FIG. 6 shows the relationship between the continuation time of the DPF regeneration and the temperature at the front end surface of the DPF 6 in case of the exhaust gas-based temperature rise. FIG. 7 shows the relationship between the flow rate of the exhaust gas and the burning rate of the particulate matters deposited in the DPF 6.

As shown in FIG. 6, as the flow rate of air taken into the engine 2 is increased, the flow rate of the exhaust gas is increased. Further, the dissipated heat per unit flow rate of the exhaust gas is decreased with the increase of the flow rate of the exhaust gas. That is, the dissipated heat from the DPF 6 is decreased with the increase of the flow rate of the taken air. Therefore, in case of the exhaust gas-based temperature rise, the temperature at the front end surface of the DPF 6 receiving the heat from the exhaust gas is increased with the flow rate of the taken air.

Accordingly, in case of the exhaust gas-based temperature rise, the temperature of the DPF 6 can be increased with the flow rate of the taken air so as to efficiently burn the particulate matters of the DPF 6.

As shown in FIG. 7, when the flow rate of the exhaust gas entering the DPF 6 is increased, the quantity of the particulate matters of the DPF 6 burned per unit time is increased. More specifically, when the flow rate of the exhaust gas is low, the burning rate of the particulate matters in the DPF 6 in case of the hydrocarbon-based temperature rise is higher than that in case of the exhaust gas-based temperature rise. That is, the period of time required to regenerate the DPF 6 in the hydrocarbon-based temperature rise is shorter than that in the exhaust gas-based temperature rise. However, in case of the exhaust gas-based temperature rise, because the temperature of the DPF 6 is increased with the flow rate of the exhaust gas (see FIG. 6), the burning rate of the particulate matters is rapidly increased with the flow rate of the exhaust gas. Therefore, when the flow rate of the exhaust gas is high, the burning rate of the particulate matters in the DPF 6 in case of the exhaust gas-based temperature rise is higher than that in case of the hydrocarbon-based temperature rise. That is, the period of time required to regenerate the DPF 6 in the exhaust gas-based temperature rise is shorter than the period of time required to regenerate the DPF 6 in the hydrocarbon-based temperature rise.

As a result, the results shown in FIG. 7 indicate that the selection (at step S150) of the exhaust gas-based temperature rise or the hydrocarbon-based temperature rise according to the flow rate of the air is advantageous to shorten the period of time required to regenerate the DPF 6.

Accordingly, in case of a low flow rate of the air taken in the engine 2, when the control device 1 selects the hydrocarbon-based temperature rise as the DPF regeneration method, the period of time required for the DPF regeneration can be shortened while the fuel economy is maintained at the high level. In contrast, in case of a high flow rate of the air taken in the engine 2, when the control device 1 selects the exhaust gas-based temperature rise as the DPF regeneration method, the period of time required for the DPF regeneration can be shortened while the fuel economy is maintained at the comparatively high level. Further, when the control device 1 selects the exhaust gas-based temperature rise, the particulate matters deposited on the front end surface of the DPF 6 can reliably be burned off.

Further, during the driving operation of the engine 2, the temperature of the DPF 6 is normally lower than the value T1. Therefore, in a case where the driving operation is performed at the flow rate of the air lower than the value G1, the ECU 9 selects the exhaust gas-based temperature rise at the earlier time of the DPF regeneration. Therefore, the particulate matters deposited in the DPF 6 are burned while the particulate matters deposited on the front end surface of the DPF are removed. Thereafter, when the temperature of the DPF 6 becomes equal to or higher than the value T1, the ECU 9 changes the selection of the DPF regeneration method to the hydrocarbon-based temperature rise to burn and remove the particulate matters still remaining in the DPF 6 in the shorter regeneration time.

Accordingly, because the control device 1 can change the selection of the DPF regeneration method during the DPF regeneration, the control device 1 can controls the regeneration of the DPF 6 in the single DPF system to rapidly remove the particulate matters of the DPF 6 and to reliably remove the particulate matters deposited on the front end surface of the DPF 6.

Further, the temperature at the outlet of the DPF 6 clearly indicates the oxidation of the unburned hydrocarbons burned in the DPF 6, as compared with the temperature at the inlet of the DPF 6. Accordingly, as compared with a case where the internal temperature of the DPF 6 is estimated from the temperature at the inlet of the DPF 6, the internal temperature of the DPF 6 can be reliably estimated from the temperature at the outlet of the DPF 6. That is, because the internal temperature of the DPF 6 is estimated from the temperature at the outlet of the DPF 6, the catalytic activity can be judged with higher precision, so that the fuel economy can further be improved.

Embodiment 2

In the first embodiment, the DPF regeneration method is selected based on the internal temperature of the DPF 6 and the flow rate of the air taken in the engine 2. In contrast, in the second embodiment, the selection of the DPF regeneration method is performed based on the internal temperature of the DPF 6 and the quantity of particulate matters deposited in the DPF 6. Further, during the DPF regeneration, the hydrocarbon-based temperature rise selected as the DPF regeneration method is changed to the exhaust gas-based temperature rise at a timing determined based on the quantity of particulate matters still remaining in the DPF 6.

Figure 8:
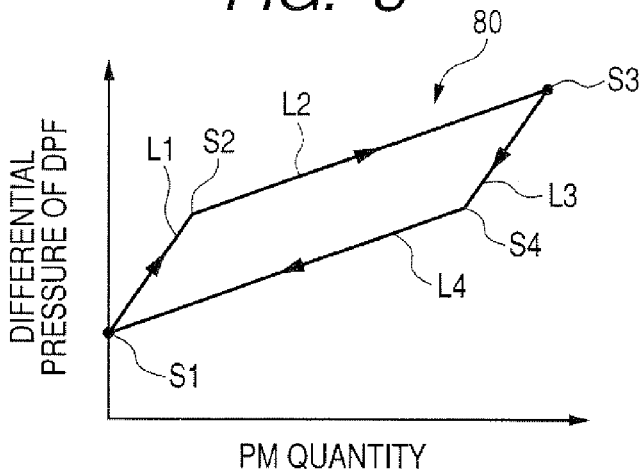
FIG. 8 shows a state transition map indicating the relationship between the differential pressure at the DPF and the quantity of particulate matters deposited in the DPF.

The relationship between the differential pressure at the DPF 6 and the quantity of particulate matters deposited in the DPF 6 is described with reference to FIG. 8. FIG. 8 shows a state transition map 80 indicating the relationship between the differential pressure at the DPF 6 and the quantity (PM quantity) of particulate matters deposited in the DPF 6.

As shown in FIG. 8, when no particulate matters are deposited in the DPF 6, the differential pressure between the inlet and the outlet of the DPF 6 is indicated by the value of an initial state S1 in the map 80. For example, when the DPF 6 is not yet used or when all particulate matters deposited in the DPF 6 are burned off, the DPF 6 has the minimum differential pressure indicated by the state S1. Then, when particulate matters are successively deposited in the DPF 6 during the driving operation of the engine 2, the differential pressure is rapidly increased along a first PM increase characteristic line L1, and the DPF 6 reaches a second state S2. After the second state S2, the differential pressure is gradually increased along a second PM increase characteristic line L2. The pressure increasing rate in the state transfer along the line L2 is smaller than that along the line L1.

When the DPF 6 reaches a third state S3, the quantity of the particulate matters reaches an upper allowable value. Therefore, the combustion of the particulate matters deposited in the DPF 6 is started, the differential pressure is rapidly decreased along a first PM decrease characteristic line L3, and the DPF 6 reaches a fourth state S4. After the fourth state S4, the differential pressure is gradually decreased along a second PM decrease characteristic line L4. The pressure decreasing rate in the state transfer along the line L4 is smaller than that along the line L3. When all particulate matters deposited in the DPF 6 are burned off, the DPF 6 returns to the state S1.

When the quantity of the particulate matters is large or when the DPF 6 is placed near the state S3, the particulate matters can be easily burned at a large burning rate. That is, a large quantity of particulate matters can be burned briskly. In contrast, when the quantity of the particulate matters is small or when the DPF 6 is placed near the state S1, the particulate matters are burned at a small burning rate.

Further, the hydrocarbon-based temperature rise is superior in the temperature rising of the whole DPF 6 to the exhaust gas-based temperature rise. That is, the temperature of the whole DPF 6 can be rapidly risen according to the hydrocarbon-based temperature rise, as compared with that according to the exhaust gas-based temperature rise. As the average temperature of the DPF 6 is risen at higher speed, a larger quantity of particulate matters can be burned. Therefore, when the quantity of particulate matters is large, it is advantageous to remove the particulate matters according to the hydrocarbon-based temperature rise. In contrast, when the quantity of particulate matters is decreased to a small value, it is advantageous to remove the particulate matters according to the exhaust gas-based temperature rise for the purpose of reliably removing the particulate matters deposited on the front end surface of the DPF 6.

In this embodiment, when the quantity of the particulate matters deposited in the DPF 6 is equal to or larger than a predetermined value M1 on condition that the temperature of the DPF 6 is sufficiently high so as to activate the catalyst of the DPF 6, the control device 1 selects the hydrocarbon-based temperature rise as the DPF regeneration method to quickly burn a large quantity of particulate matters at a large burning rate. In contrast, when the quantity of the particulate matters is decreased to be smaller than the value M1, the control device 1 selects the exhaust gas-based temperature rise as the DPF regeneration method to reliably burn the particulate matters still remaining on the front end surface of the DPF 6.

Figure 9:
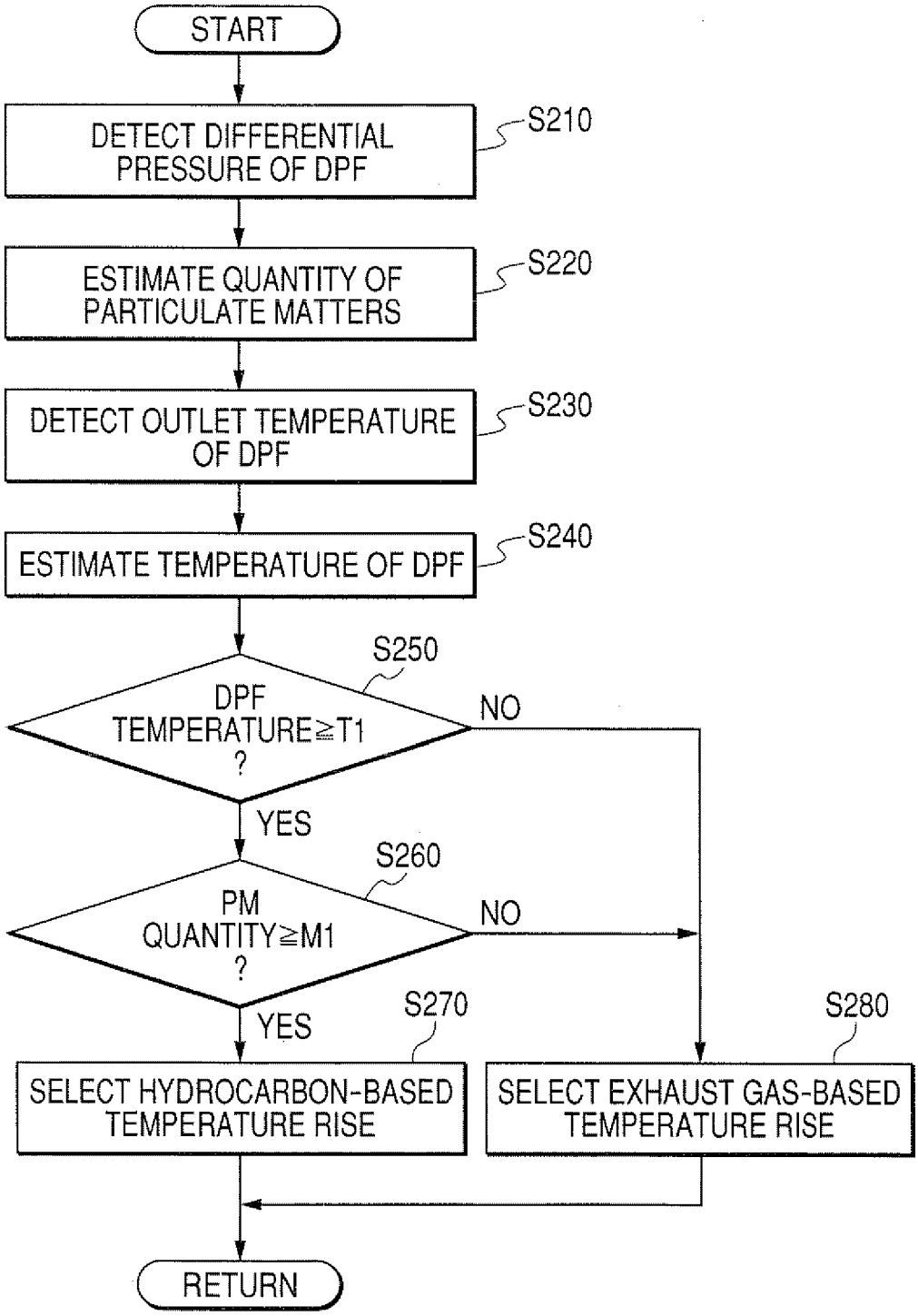
FIG. 9 is a flow chart showing the selection of the DPF regeneration method according to the second embodiment of the present invention.

FIG. 9 is a flow chart showing the selection of the DPF regeneration method according to the second embodiment. In this selection, the flow meter 4 is not used.

As shown in FIG. 9, at step S210, the ECU 9 detects the differential pressure at the DPF 6. This differential pressure is measured by the sensor 7. At step S220, the ECU 9 estimates the quantity of particulate matters deposited in the DPF 6 with reference to the map 80 shown in FIG. 8. For example, when the DPF regeneration is not yet started (the proceedings from step S50 to step S60 in FIG. 4), the ECU 9 judges that the deposition of particulate matters on the DPF 6 is continued while changing the differential pressure along the lines L1 and L2 of the map 80. Therefore, the ECU 9 estimates the quantity of the particulate matters from the detected differential pressure and the lines L1 and L2 of the map 80. In contrast, when the DPF regeneration is continued (the proceedings from step S20 to step S60 in FIG. 4), the ECU 9 judges that the differential pressure is decreased along the lines L3 and L4 of the map 80. Therefore, the ECU 9 estimates the quantity of the deposited particulate matters from the detected differential pressure and the lines L3 and L4.

At step S230, the ECU 9 detects the outlet temperature of the DPF 6 at the outlet side of the DPF 6. At step S240, the ECU 9 estimates the internal temperature of the DPF 6 from the outlet temperature measured by the sensor 8. The detection of the outlet temperature at step S230 and the estimation of the internal temperature at step S340 are performed in the same manner as those at step S120 and S130 (see FIG. 5).

At step S250, the ECU 9 judges whether or not the estimated internal temperature of the DPF 6 is equal to or higher than the value T1. When the estimated internal temperature is equal to or higher than the value T1, the procedure proceeds to step S260. In contrast, when the estimated internal temperature is lower than the value T1, the procedure proceeds to step S280.

At step S260, the ECU 9 judges whether or not the quantity (PM quantity) of the particulate matters estimated at step S220 is equal to or larger than the value M1. When the estimated quantity is equal to or larger than the value M1, the procedure proceeds to step S270. In contrast, when the estimated quantity is smaller than the value M1, the procedure proceeds to step S280.

At step S270, the ECU 9 selects the hydrocarbon-based temperature rise as the DPF regeneration method. Then, this process is completed.

At step S280, the ECU 9 selects the exhaust gas-based temperature rise as the DPF regeneration method. Then, this process is completed.

Therefore, when a large quantity of particulate matters are deposited in the DPF 6 of which the internal temperature of the DPF 6 is sufficiently high to activate the catalyst, the control device 1 initially selects the hydrocarbon-based temperature rise as the DPF regeneration method. Then, when the quantity of the particulate matters deposited in the DPF 6 is decreased to be smaller than the value M1, the control device 1 changes the selection of the DPF regeneration method to the exhaust gas-based temperature rise.

Figure 10:
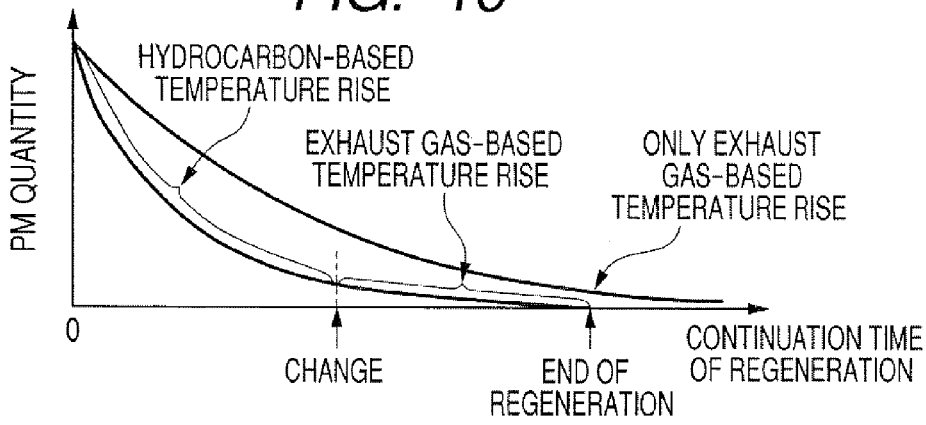
FIG. 10 shows the relationship between the continuation time of the DPF regeneration and the quantity of the particulate matters deposited in the DPF.

Effects in the second embodiment are now described with reference to FIG. 10. FIG. 10 shows the relationship between the continuation time of the DPF regeneration and the quantity (PM quantity) of the particulate matters deposited in the DPF 6.

As shown in FIG. 10, when the ECU 9 initially selects the hydrocarbon-based temperature rise, a large quantity of particulate matters deposited in the DPF 6 can be rapidly burned briskly at a large burning rate. Accordingly, when the ECU 9 initially selects the hydrocarbon-based temperature rise and changes the selection of the DPF regeneration method to the exhaust gas-based temperature rise, a period of time required to burn all deposited particulate matters can be shortened as compared with a case where the exhaust gas-based temperature rise is always selected during the DPF regeneration.

Further, because the ECU 9 finally selects the exhaust gas-based temperature rise, the particulate matters deposited on the front end surface of the DPF 6 can be reliably burned off.

Embodiment 3

In the third embodiment, the control device 1 selects the DPF regeneration method based on the internal temperature of the DPF 6, the flow rate of air taken in the engine 2 and the quantity of particulate matters deposited in the DPF 6.

Figure 11:
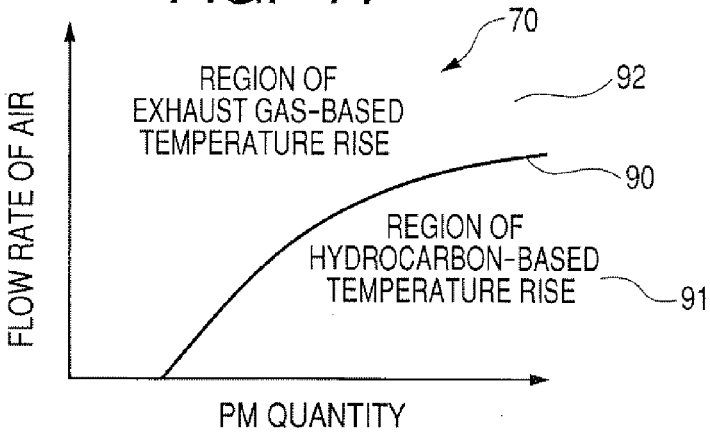
FIG. 11 shows a map indicating both a region of the hydrocarbon-based temperature rise and a region of the exhaust gas-based temperature rise.

FIG. 11 shows a map 70 indicating both a region of the hydrocarbon-based temperature rise and a region of the exhaust gas-based temperature rise in a plane defined by both the flow rate of air taken in the engine 2 and the quantity (PM quantity) of particulate matters deposited in the DPF 6 according to the third embodiment.

As shown in FIG. 11, a plane defined by both the flow rate of air taken in the engine 2 and the quantity of particulate matters deposited in the DPF 6 is divided into a region 91 of the hydrocarbon-based temperature rise and a region 92 of the exhaust gas-based temperature rise. When the combination of the air flow rate and the quantity of the particulate matters is placed in the region 91, the ECU 9 selects the hydrocarbon-based temperature rise as the DPF regeneration method. In contrast, when the combination of the air flow rate and the quantity of the particulate matters is placed in the region 92, the ECU 9 selects the exhaust gas-based temperature rise as the DPF regeneration method.

More specifically, as the flow rate of the air is increased, the upper limit of the quantity of the particulate matters in the region 92 is heightened. This region division accords with the idea according to the first embodiment. Further, as the quantity of the particulate matters is increased, the upper limit of the air flow rate in the region 91 is heightened. This region division accords with the idea according to the second embodiment.

The boundary line 90 dividing the plane into the regions 91 and 92 is appropriately determined by the experiments or simulations.

Figure 12:
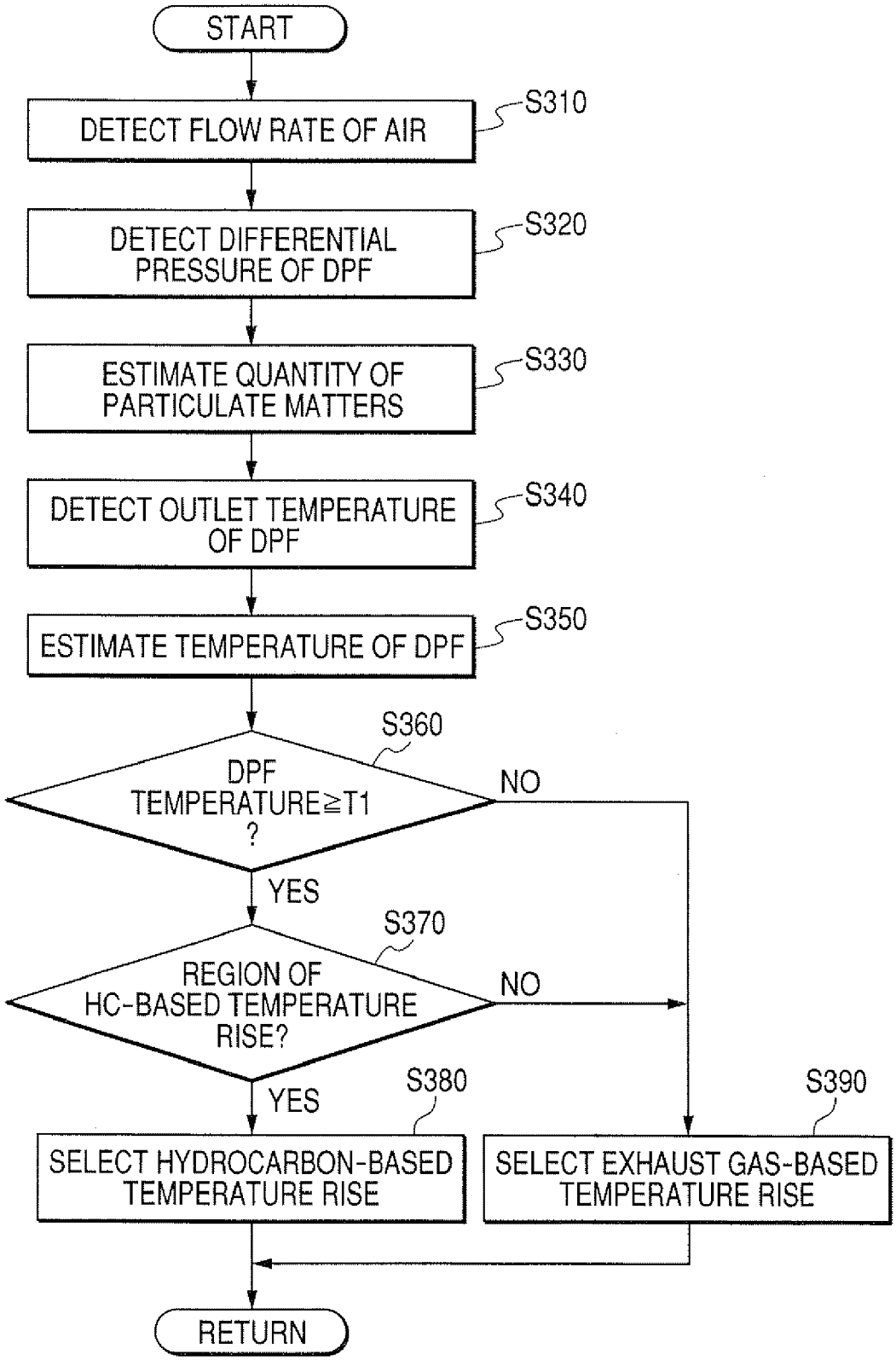
FIG. 12 is a flow chart showing the selection of the DPF regeneration method according to the third embodiment of the present invention.

FIG. 12 is a flow chart showing the selection of the DPF regeneration method according to the third embodiment.

As shown in FIG. 12, at step S310, the ECU 9 detects the flow rate of new air taken in the engine 2. This detection of the air flow rate is performed in the same manner as at step S110 (see FIG. 5).

At step S320, the ECU 9 detects the differential pressure at the DPF 6. At step S330, the ECU 9 estimates the quantity of particulate matters deposited in the DPF 6. These detection and estimation are performed in the same manner as those at step S210 and S220 (see FIG. 9).

At step S340, the ECU 9 detects the outlet temperature of the DPF 6 at the outlet side of the DPF 6. At step S350, the ECU 9 estimates the internal temperature of the DPF 6 from the outlet temperature. These detection and estimation are performed in the same manner as those at step S120 and S130 (see FIG. 5).

At step S360, the ECU 9 judges whether or not the estimated internal temperature of the DPF 6 is equal to or higher than the value T1. When the estimated internal temperature is equal to or higher than the value T1, the procedure proceeds to step S370. In contrast, when the estimated internal temperature is lower than the value T1, the procedure proceeds to step S390.

At step S370, the ECU 9 judges with reference to the map 70 shown in FIG. 11 whether or not the combination of the flow rate of the new air detected at step S310 and the quantity of the particulate matters estimated at step S330 is placed in the region of the hydrocarbon-based (HC-based) temperature rise. When the combination is placed in the region of the hydrocarbon-based temperature rise, the procedure proceeds to step S380. In contrast, when the combination is placed in the region of the exhaust gas-based temperature rise, the procedure proceeds to step S390.

At step S380, the ECU 9 selects the hydrocarbon-based temperature rise as the DPF regeneration method. Then, this process is completed.

At step S390, the ECU 9 selects the exhaust gas-based temperature rise as the DPF regeneration method. Then, this process is completed.

Therefore, when the flow rate of the new air is comparatively small, the ECU 9 initially selects the hydrocarbon-based temperature rise. When the quantity of the particulate matters is sufficiently decreased, the ECU 9 changes the selection of the DPF regeneration method to the exhaust gas-based temperature rise. Accordingly, the control device 1 can shorten a period of time required to burn all particulate matters while reliably removing the particulate matters deposited on the front end surface of the DPF 6.

In contrast, when the flow rate of the new air is comparatively large, the ECU 9 selects the exhaust gas-based temperature rise as the DPF regeneration method during the whole DPF regeneration. Accordingly, the control device 1 can reliably burn off the particulate matters deposited on the front end surface of the DPF 6 while maintaining the fuel economy at the comparatively high level.

In conclusion, in the embodiments, because the control device 1 can appropriately select one of the exhaust gas-based temperature rise and the hydrocarbon-based temperature rise so as to rapidly rise the temperature of the DPF 6 and to rapidly burn particulate matters deposited in the DPF 6, the control device 1 can appropriately control the regeneration of the DPF 6 in the single DPF system.

Modifications of the Embodiments

The ECU 9 estimates the internal temperature of the DPF 6 from the outlet temperature of the DPF 6 measured by the sensor 8 with reference to the map indicating the relationship between the internal temperature and the outlet temperature. However, the present invention is not limited to this estimation. For example, in addition to the sensor 8, the control device 1 may have a temperature sensor disposed at the inlet side of the DPF 6 to measure the inlet temperature of the DPF 6. Further, the molar flow rate of air corresponding to the air flow rate measured in the flow meter 4 may be regarded as the molar flow rate of exhaust gas passing through the DPF 6. The ECU 9 prepares a map indicating the internal temperature of the DPF 6 from the outlet temperature of the DPF 6, the inlet temperature of the DPF 6 and the flow rate of exhaust gas passing through the DPF 6, and the ECU 9 estimates the internal temperature of the DPF 6 from the inlet and outlet temperatures measured by the sensors and the flow rate of the exhaust gas with reference to the map. In this estimation, because the inlet and outlet temperatures are used, the ECU 9 can estimate the internal temperature of the DPF 6 with higher precision.

In these embodiments, because the technique for efficiently purifying the exhaust gas with higher reliability has been required for the diesel engines, the control device 1 is disposed for the diesel engine. However, the control device 1 may also be disposed for a lean burn gasoline engine.

These embodiments should not be construed as limiting the present invention to structures of those embodiments, and the structure of this invention may be combined with that based on the prior art.

What is claimed is:

1. An exhaust emission control device which controls fuel injected into an internal combustion engine to remove particulate matters deposited in a particulate filter arranged in an exhaust pipe connected to the engine, comprising:

a catalyst judging block configured to judge whether a catalyst held in the particulate filter is in an active state or in an inactive state;

a determining block configured to determine which of a first fuel injection type and a second fuel injection type should be used to inject the fuel into the internal combustion engine, when the catalyst judging block determines that the catalyst held in the particulate filter is in the active state, the first fuel injection type injecting the fuel to the internal combustion engine to heighten a temperature of the exhaust gas, the second fuel injection type injecting the fuel to the engine to supply an unburned hydrocarbon to the particulate filter; and a control unit configured to control the fuel injected into the engine based on a determined result by the determining block; wherein: the control unit includes an exhaust gas detecting block configured to detect a flow rate of exhaust gas which is currently outputted from the engine and passes through the particulate filter, and the determining block determines which of the first fuel injection type and the second fuel injection type should be used to inject the fuel into the engine, according to the currently detected flow rate of the exhaust gas.

2. An exhaust emission control device which controls fuel injected into an internal combustion engine to remove particulate matters deposited in a particulate filter arranged in an exhaust pipe connected to the engine, comprising:

a catalyst judging block configured to judge whether a catalyst held in the particulate filter is in an active state or in an inactive state;

an exhaust gas detecting block configured to detect a flow rate of exhaust gas which is currently outputted from the engine and passes through the particulate filter;

a determining block configured to determine which of a first fuel injection type and a second fuel injection type should be used to inject the fuel into the internal combustion engine, according to the currently detected flow rate of the exhaust gas, when the catalyst judging block determines that the catalyst held in the particulate filter is in the active state, the first fuel injection type injecting the fuel to the internal combustion engine to heighten a temperature of the exhaust gas, the second fuel injection type injecting the fuel to the engine to supply an unburned hydrocarbon to the particulate filter, an injection type selecting block configured to select either the first fuel injection type or the second fuel injection type, wherein the injection type selecting block is configured to select the first fuel injection type when the determining block determines the first fuel injection type; and a fuel injection control block configured to control the fuel injected into the internal combustion engine based on the first fuel injection type when the injection type selecting block selects the first fuel injection type and based on the second fuel injection type when the injection type selecting block selects the second fuel injection type.

3. The device according to claim 2, wherein the particulate filter has no oxidation catalyst on an upstream side thereof.

4. The device according to claim 2, wherein the injection type selecting block is adapted to select the first fuel injection type when the flow rate of the exhaust gas detected in the exhaust gas detecting block is larger than a predetermined value and to select the second fuel injection type when the flow rate of the exhaust gas is smaller than the predetermined value.

5. The device according to claim 2, wherein the determining block is configured to determine which of the first fuel injection type and the second fuel injection type can raise temperature of the particulate filter more rapidly than the other under a condition of the detected flow rate of the exhaust gas.

6. The device according to claim 2, wherein the catalyst judging block is adapted to judge the catalyst to be in the active state when a temperature of the particulate filter is higher than a predetermined value and to judge the catalyst to be in the inactive state when the temperature of the particulate filter is lower than the predetermined value.

7. The device according to claim 6, further comprising an exhaust gas temperature sensor configured to measure a temperature of the exhaust gas at an outlet side of the particulate filter as the temperature of the particulate filter.

8. The device according to claim 2, further comprising an air flow meter configured to measure a flow rate of air currently taken into the internal combustion engine, wherein the exhaust gas detecting block regards the measured flow rate as the flow rate of the exhaust gas.

9. The device according to claim 2, further comprising an estimating block configured to estimate an amount of the particulate matters deposited in the particulate filter, wherein the determining block is adapted to determine which of the first fuel injection type and the second fuel injection type should be used to inject the fuel into the internal combustion engine, according to both the flow rate of the exhaust gas and the amount of the particulate matters estimated in the estimating block.

10. The device according to claim 9, wherein the injection type selecting block is adapted to prepare a judging plane defined by both the amount of the particulate matters and the flow rate of the exhaust gas, to divide the judging plane into a first region and a second region such that the amount of the particulate matters in the first region is smaller than that in the second region in any fixed flow rate of the exhaust gas and such that the flow rate of the exhaust gas in the first region is larger than that in the second region in any fixed amount of the particulate matters, to select the first fuel injection type when the combination of the amount of the particulate matters and the flow rate of the exhaust gas is placed in the first region, and to select the second fuel injection type when the combination of the amount of the particulate matters and the flow rate of the exhaust gas is placed in the second region.

11. The device according to claim 9, further comprising a differential pressure sensor configured to detect a differential pressure in the exhaust gas between an inlet of the particulate filter receiving the exhaust gas and an outlet of the particulate filter, wherein the estimating block is adapted to estimate the amount of the particulate matters from the differential pressure detected by the differential pressure sensor.

12. The device according to claim 11, wherein the estimating block is adapted to prepare an estimating map indicating relationship between the differential pressure detected by the differential pressure sensor and an amount of the particulate matters deposited in the particulate filter and estimate the amount of the particulate matters from the differential pressure and the estimating map.

13. An exhaust emission control device which controls fuel injected into an internal combustion engine to remove particulate matters deposited in a particulate filter arranged in an exhaust pipe connected to the engine, comprising:

a catalyst judging block configured to judge whether or not a catalyst held in the particulate filter is in an active state or in an inactive state;

an estimating block configured to estimate an amount of the particulate matters held in the filter;

a determining block configured to determine which of a first fuel injection type and a second fuel injection type should be used to inject the fuel into the internal combustion engine, according to the estimated amount of the particulate matters, when the catalyst judging block determines that the catalyst held in the particulate filter is in the active state, the first fuel injection type injecting the fuel to the internal combustion engine to heighten a temperature of the exhaust gas, the second fuel injection type injecting the fuel to the engine to supply an unburned hydrocarbon to the particulate filter, an injection type selecting block configured to select either the first fuel injection type or the second fuel injection type, wherein the injection type selecting block is configured to select the first fuel injection type when the determining block determines the first fuel injection type; and a fuel injection control block configured to control the fuel injected into the internal combustion engine based on the first fuel injection type when the injection type selecting block selects the first fuel injection type and based on the second fuel injection type when the injection type selecting block selects the second fuel injection type.

14. The device according to claim 13, wherein the particulate filter has no oxidation catalyst on an upstream side thereof.

15. The device according to claim 13, wherein the injection type selecting block is adapted to select the first fuel injection type when the amount of the particulate matters detected in the exhaust gas detecting block is smaller than a predetermined value and to select the second fuel injection type when the amount of the particulate matters is larger than the predetermined value.

16. The device according to claim 13, wherein the determining block is configured to determine which of the first fuel injection type and the second fuel injection type can raise temperature of the particulate filter more rapidly than the other under a condition of the estimated amount of the particulate matters.

17. The device according to claim 16, wherein the catalyst judging block is adapted to judge the catalyst to be in the active state when a temperature of the particulate filter is higher than a predetermined value and to judge the catalyst to be in the inactive state when the temperature of the particulate filter is lower than the predetermined value.

18. The device according to claim 17, further comprising an exhaust gas temperature sensor configured to measure a temperature of the exhaust gas at an outlet side of the particulate filter as the temperature of the particulate filter.

19. The device according to claim 13, further comprising a differential pressure sensor configured to detect a differential pressure in the exhaust gas between an inlet of the particulate filter receiving the exhaust gas and an outlet of the particulate filter, wherein the estimating block is adapted to estimate the amount of the particulate matters from the differential pressure detected by the differential pressure sensor.

20. The device according to claim 19, wherein the estimating block is adapted to prepare an estimating map indicating relationship between the differential pressure detected by the differential pressure sensor and an amount of the particulate matters deposited in the particulate filter and estimate the amount of the particulate matters from the differential pressure and the estimating map.

* * * * *